US005769652A

United States Patent [19]

Wider

[11] Patent Number: 5,769,652

[45] Date of Patent: Jun. 23, 1998

[54] FLOAT MOUNT COAXIAL CONNECTOR

[75] Inventor: Eric S. Wider, East Haven, Conn.

[73] Assignee: Applied Engineering Products, Inc., Conn.

[21] Appl. No.: 777,808

[22] Filed: Dec. 31, 1996

[51] Int. Cl.[6] ..... H01R 13/64

[52] U.S. Cl. ..... 439/248; 439/63

[58] Field of Search ..... 439/247, 248, 439/63, 252

[56] References Cited

U.S. PATENT DOCUMENTS

| | | | |
|---|---|---|---|
| 4,358,174 | 11/1982 | Dreyer . | |
| 4,426,127 | 1/1984 | Kubota . | |
| 4,580,862 | 4/1986 | Johnson . | |
| 4,815,986 | 3/1989 | Dholoo | 439/248 |
| 4,929,188 | 5/1990 | Lionetto et al. | 439/349 |
| 4,941,836 | 7/1990 | Bormuth | 439/247 |
| 5,329,262 | 7/1994 | Fisher, Jr. | 439/248 |
| 5,516,303 | 5/1996 | Yohn et al. | 439/248 |

*Primary Examiner*—Gary F. Paumen
*Attorney, Agent, or Firm*—Anthony J. Casella; Gerald E. Hespos; Ludomir A. Budzyn

[57] ABSTRACT

A coaxial connector includes front and rear bodies and front and rear contacts that can float relative to one another during mating with another coaxial connector. A wave washer between the front and rear bodies ensures a high quality contact between the front and rear bodies and urges the front and rear bodies toward axial parallel alignment with one another. Similarly, a spring between the front and rear contacts permits the front contact to float with the front body and relative to the rear contact and the rear body. The spring between the front and rear contacts maintains signal transmission capabilities.

8 Claims, 4 Drawing Sheets

FLOAT MOUNT COAXIAL CONNECTOR

BACKGROUND OF THE INVENTION

1. Field of the Invention

The subject invention relates generally to coaxial connectors, and particularly to coaxial connectors that can float to achieve proper alignment for mating.

2. Description of the Prior Art

A prior art coaxial connector includes an inner conductor or contact and an outer conductor or body concentrically disposed around the contact. A prior art coaxial connector also includes an insulator between the contact and the body to maintain separation therebetween and to ensure substantially coaxial alignment.

Prior art coaxial connectors are used in pairs, and are constructed to permit push-pull interconnection. In particular, two mateable connectors can be axially aligned and then urged toward one another. This axial movement causes a center female contact on one connector to engage a center pin contact on the mating connector. Similarly, one of the mateable connectors typically includes a plurality of resiliently deflectable fingers defining the mating end of the outer conductor or body. The fingers resiliently deflect during mating and securely grip the outer conductor or body of the mated connector to maintain high quality electrical and mechanical connection between the respective connectors. Unmating typically can be achieved by merely pulling the connectors away from one another.

The front or mating end of a prior art coaxial connector typically is provided with a chamfer to facilitate alignment during mating. The chamfer typically is adequate to achieve precise alignment in situations where one cable mounted connector is being mated with another cable mounted connector. However, coaxial connectors often are mounted to panels or printed circuit boards. The respective panels or printed circuit boards often are disposed at locations on an apparatus where accurate visual alignment cannot be achieved prior to and during mating. To further complicate matters, many types of communication equipment require a plurality of coaxial connectors to be mated simultaneously. Thus, a printed circuit board or panel may be provided with an array of coaxial connectors that must be mated with a corresponding array of coaxial connectors mounted to a separate panel or board. One panel or board must be urged toward the other to simultaneously mate all of the connector pairs. Blind mating problems are complicated by even small variations from the specified positions of the connectors on the panels or circuit boards.

The prior art includes coaxial connectors that can float on a panel to achieve alignment during mating. For example, U.S. Pat. No. 4,358,174 issued to Charles W. Dreyer on Nov. 9, 1982 and shows first and second mateable panel-mounted coaxial connectors. Each connector includes opposed front and rear ends. The front ends of the respective connectors are mateable with each other. The rear ends of the connectors are mounted to conventional coaxial cables. The connectors are mounted in apertures passing through the respective panels. A flange near the front of each connector is disposed on one side of the respective panel, and a nut is threadedly connected to the rear of the connector from the opposed side of the respective panel. Thus the flange and the nut position the connector relative to the panel. The first connector is dimensioned relative to its mounting aperture to achieve secure substantially immovable mounting to the respective panel. The second coaxial connector, however, is cross-sectionally smaller than the mounting aperture in its panel.

Additionally, the panel engaging nut and flange on the second connector do not tightly engage the opposed sides of the panel. Thus, the entire second connector can float both axially and radially on the panel. The second connector further includes a wave washer disposed between the flange on the second connector and an opposed surface of the mounting panel. The wave washer biases the second connector into substantially orthogonal alignment to the panel. However, forces generated during mating of the respective connectors enable the entire second connector to float radially, move axially or skew itself relative to the panel until proper alignment and full mating has been achieved.

Other prior art coaxial connectors have included assemblies of coil springs to permit float between the connector and the panel. Prior art connectors with coil springs for achieving float between a connector and a panel are generally less desirable than the connector shown in the above-referenced U.S. Pat. No. 4,358,174 in that a coil spring that surrounds the entire connector adds significantly to the overall axial and radial dimensions of the connector. In this regard, industry-accepted standards impose tight dimensional limitations on coaxial connectors.

The use of nuts, flanges and springs to permit an entire coaxial connector to float on a panel has been acceptable for many prior art panels. However, current technology often requires soldered connection of both the center and outer conductors of a coaxial connector to conductive traces on the circuit board. These soldered connections do not permit float of the entire connector as had been done in the prior art.

In view of the above, it is an object of the subject invention to provide a coaxial connector with an enhanced ability to float during mating.

It is another object of the subject invention to provide a coaxial connector that achieves efficient reliable floating without increasing the dimensional size of the connector.

It is a further object of the subject invention to provide a floatable coaxial connector that can be soldered to a circuit board.

Another object of the subject invention is to provide a floatable coaxial connector that can be adapted for mounting other than a soldered mounting to a printed circuit board, such as designs where the rear end of the connector is securely mounted by a flange, a threaded bulkhead mount or the like, while the front or interface end is floatable.

SUMMARY OF THE INVENTION

The subject invention is directed to a coaxial connector having a generally tubular body assembly, a contact assembly disposed concentrically within the body assembly and an insulator assembly supporting the contact assembly within the body assembly. The body assembly defines the outer conductor or ground for the coaxial connector. The contact assembly defines the center conductor for carrying signals through the coaxial connector.

The body assembly of the subject coaxial connector comprises a front body and a rear body. The rear body includes opposed front and rear ends and a passage extending axially therethrough. The passage through the rear body may have a large diameter rear entrance and a small diameter front entrance. The small diameter front entrance to the passage through the rear body may be defined by an inwardly extending flange near the front end of the rear body. The rear end of the rear body may be configured for mounting the coaxial connector to a printed circuit board or panel. In particular, the rear body may include a plurality of rearwardly projecting legs disposed and dimensioned for insertion through a corresponding array of apertures through a printed circuit board or panel. The legs of the rear body may be soldered to conductive traces on the circuit board or panel to provide connection between the body assembly and ground.

The front body of the body assembly also is generally tubular and includes opposed front and rear ends and a passage extending axially therebetween. Portions of the front body forwardly of the rear end define an outside diameter smaller than the inside diameter defined by the flange at the front end of the rear body. These portions of the front body are loosely positioned through the small diameter passage entry defined by the inwardly extending flange at the front end of the rear body.

The extreme rear end of the front body has an outside diameter greater than the inside diameter of the flange at the front end of the rear body. In particular, the rear end of the front body may be flared outwardly to define a rear flange. Thus, engagement between the rear flange of the front body and the flange of the rear body limits the amount of forward movement of the front body relative to the rear body, and prevents complete separation between the front and rear bodies of the body assembly.

The front body is further characterized by a front flange projecting outwardly therefrom at a location spaced forwardly from the rear flange by a distance greater than the axial thickness of the flange on the rear body. The front flange of the front body defines an outside diameter greater than the inside diameter of the flange on the rear body. Thus, the front flange of the front body limits the amount of rearward movement of the front body into the rear body.

The front and rear flanges of the front body effectively trap the front body relative to the flange on the rear body. Thus, the front and rear flanges of the front body permit a controlled amount of axial movement or float of the front body relative to the rear body. Additionally, the outside diameter of portions of the front body between the front and rear flanges thereof permits a controlled radial float of the front body relative to the rear body.

The body assembly further includes spring means between the front and rear bodies. The spring means may be a wave washer or a dished washer formed from a resiliently deflectable material. The spring means may function to urge the front body forwardly relative to the rear body such that the rear flange of the front body is biased against the flange of the rear body. However, rearwardly directed axial forces or radial forces exerted on the front body will permit both axial and radial float of the front body relative to the rear body and relative to the circuit board to which the rear body is soldered. The spring also functions to achieve continuous electrical engagement between the front and rear bodies for all possible float positions.

The insulator assembly comprises front and rear insulators. The rear insulator is a generally tubular structure having opposed front and rear ends and a passage extending axially therebetween. The rear end of the rear insulator includes an inwardly extending flange having a small diameter entry to the passage through the rear insulator. The rear end of the rear insulator may further include an outwardly extending flange. The rear insulator is slidably inserted into the rear end of the front body.

The front insulator also is of generally tubular shape with opposed front and rear ends and a passage extending axially therebetween. The rear end of the front insulator is dimensioned to be tightly received within the front end of the rear insulator. Upon maximum insertion, the rear end of the front insulator is spaced forwardly from the inwardly extending flange at the rear end of the rear insulator.

The contact assembly of the coaxial connector includes front and rear contacts. The rear contact is generally cylindrical and includes opposed front and rear ends. The rear contact defines an outside diameter along a major portion of its length that is less than the inside diameter defined by the inwardly extending flange at the rear end of the rear insulator. Thus, relative movement between the rear contact and the rear insulator is permitted. Portions of the rear contact near the front end thereof are provided with an outwardly extending contact flange or other similar structure to define a diameter larger than the inside diameter of the opening through the inwardly extending flange of the rear insulator. The rear contact flange or other dimensional discontinuity is disposed forwardly of the inwardly extending flange on the rear insulator, and hence limits the amount of rearward movement of the rear contact relative to the rear insulator.

The front contact also includes opposed front and rear ends. Portions of the front contact near the front end are configured for mating engagement with another coaxial connector. Portions of the front contact near the rear end are disposed rearwardly of the rear insulator. Intermediate portions of the front contact are securely engaged within the small diameter passage of the front insulator.

The contact assembly further includes a contact spring extending between the front and rear contacts. The contact spring may be a small coil spring having a rear end concentrically surrounding the front end of the rear contact, and having a front end concentrically surrounding the rear end of the front contact. The contact spring performs several functions. First, the contact spring achieves to signal transmission between the rear contact and the front contact. Additionally, the contact spring accommodates radial float, axial float and angular misalignment of the front body relative to the rear body. The front contact and the front body are maintained in substantially perfect axial alignment relative to one another. Additionally, the rear body and the rear contact can be securely soldered to a circuit board. However, both the body assembly and the contact assembly are capable of controlled float to facilitate alignment with another coaxial connector during mating.

DETAILED DESCRIPTION OF THE PREFERRED EMBODIMENT

Figure 1:
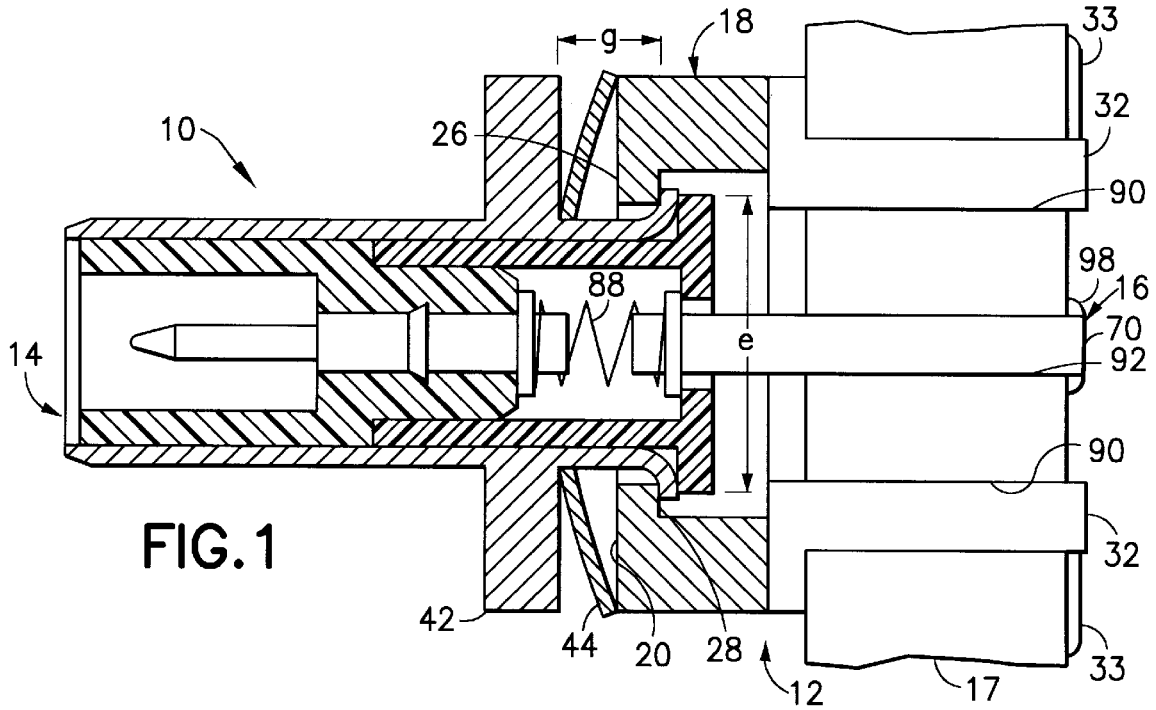
FIG. 1 is a cross-sectional view of a coaxial connector in accordance with the subject invention.
Figure 9:
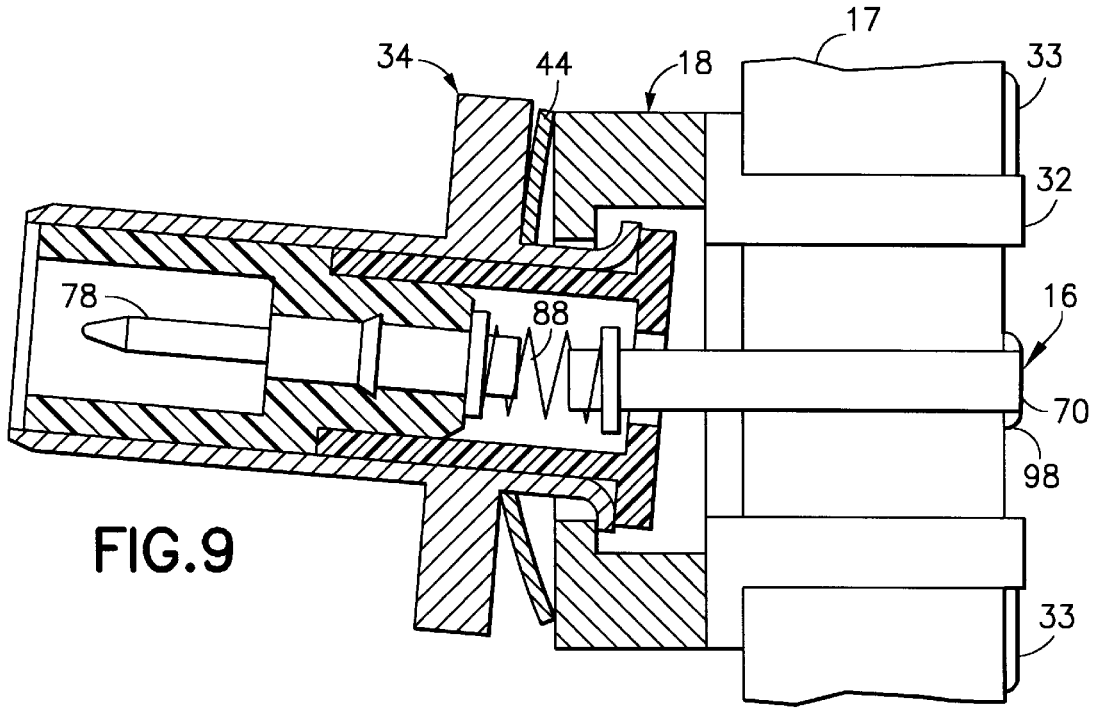
FIG. 9 is a cross-sectional view similar to FIG. 1, but showing the connector floated to a different orientation.

A coaxial connector in accordance with the subject invention is identified generally by the numeral 10 in FIG. 1. The coaxial connector 10 includes a body assembly 12, an insulator assembly 14 and a contact assembly 16. The coaxial connector 10 is rigidly secured to a circuit board 17 by soldered connections as explained further herein.

Figure 2:
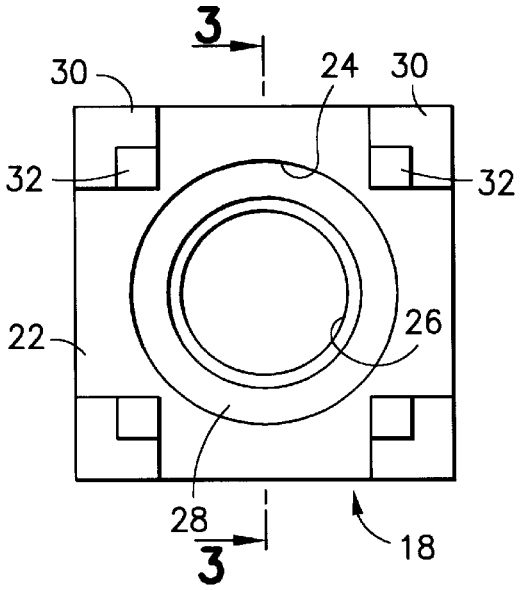
FIG. 2 is a rear elevational view of the rear body shown in FIG. 1.
Figure 3:
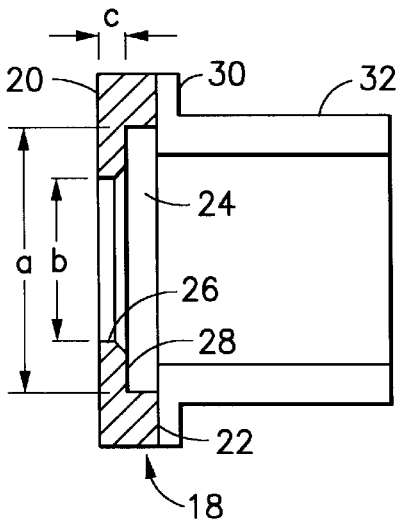
FIG. 3 is a cross-sectional view taken along line 3—3 in FIG. 2.

The body assembly 12 of the coaxial connector 10 includes a rear body 18 having opposed front and rear faces 20 and 22 respectively as shown most clearly in FIGS. 2 and 3. A stepped cylindrical passage 24 extends axially through the rear body 18 from the front face 20 to the rear face 22 thereof. Portions of the stepped cylindrical passage 24 near the rear face 22 define an inside diameter "a". The rear body 18 is further characterized by an inwardly extending flange 26 disposed at the front face 20 and defining an inside diameter "b" which is less than the inside diameter "a" on portions of the passage 24 in proximity to the rear face 22 of the rear body 18. The flange 26 includes a rear face 28 facing into the larger diameter portions of the passage 24 and defining a stop for other portions of the body assembly 12 as explained further herein. The flange 26 defines an axial length "c" measured from the front face 20 of the rear body 18 to the rear face 28 of the flange 26.

The rear body 18 further includes four equally spaced stand-off platforms 30 projecting rearwardly from the rear face 22. The platforms 30 are substantially equally dimensioned and define a planar surface for supporting the rear body 18 relative to a printed circuit board or panel. A plurality of legs 32 project rearwardly from the stand-off platforms 30 and are receivable in apertures extending through the printed circuit board or panel. The legs 32 may be connected to conductive traces 33 on the printed circuit board 17 as shown in FIG. 1 for permitting the body assembly 12 to be connected to ground.

Figure 4:
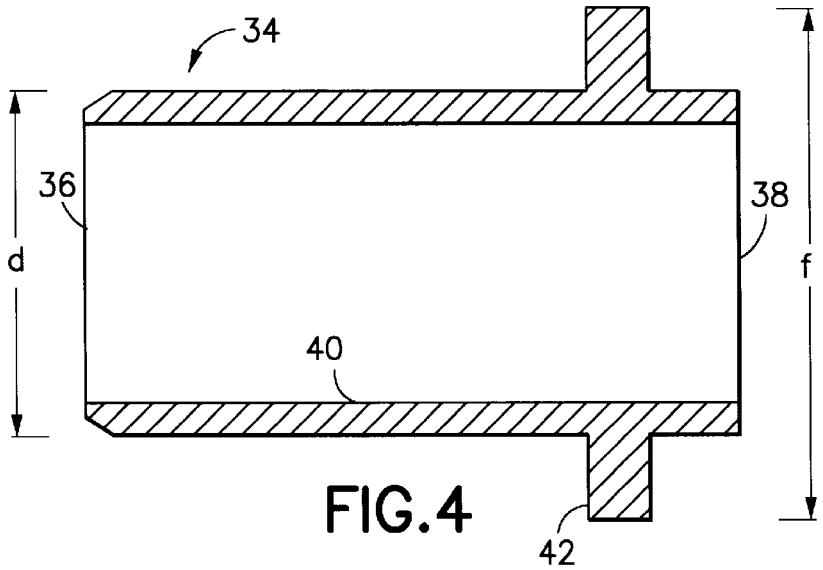
FIG. 4 is a longitudinal cross-sectional view of the front body.

The body assembly 12 further includes a front body 34 which is shown in FIG. 4 prior to assembly and deformation. The front body 34 is a generally tubular member having opposed front and rear ends 36 and 38 and a passage 40 extending axially therebetween. The front body 34 defines an outside diameter "d" along a major portion of its length. The outside diameter "d" of the front body 34 is less than the inside diameter "b" defined by the flange 26 on the rear body 18. Portions of the outer surface of the front body 34 adjacent the front end 36 thereof may be chamfered to facilitate alignment of the coaxial connector 10 with a mating connector.

The rear end 38 of the front body 34 is inserted through the flange 26 on the rear body 18 and then is flared outwardly to define an outside diameter "e" which is greater than the inside diameter "b" of the flange 26 on the rear body 18. Thus, as shown most clearly in FIG. 1, portions of the front body forwardly of the flared rear end 38 are loosely received within the cylindrical opening defined by the flange 26 on the rear body 18.

The front body 34 further includes a front flange 42 having an outside diameter "f" greater than the inside diameter "b" defined by the flange 26 of the rear body 18. The front flange 42 is spaced forwardly from the rear flange 38 by an axial distance "g" which is greater than the axial length "c" of the flange 26 on the rear body 18. Thus, portions of the front body 34 between the rear flange 38 and the front flange 42 are effectively trapped relative to the flange 26 of the rear body 18. In particular, the front body 34 can float axially relative to the rear body 18. Forward float is limited by engagement of the rear flange 38 with the rear face 28 of the flange 26 on the rear body 18. Rearward float is controlled by engagement of the front flange 42 of the front body 34 with the front face 20 of the rear body 18. Radial float also is permitted by the smaller outside diameter "d" of the front body 34 relative to the inside diameter "b" of the flange 26 on the rear body 18.

The body assembly 12 further includes a wave washer 44 disposed between the front face 20 of the rear body 18 and the front flange 42 of the front body 34. The wave washer 44 is dimensioned to bias the front body 34 forwardly such that the rear flange 38 thereof is urged against the rear face 28 of the flange 26 on the rear body 18. However, rearwardly directed forces exerted on the front body 34 will deflect the wave washer 44 and will permit rearward float of the front body 34 relative to the rear body 18. The wave washer 44 will resiliently return the front body 34 forwardly upon release of the rearward forces thereon. The wave washer 44 also functions to keep the front body 34 and the rear body 18 substantially axially parallel to one another despite any radial float that may occur therebetween.

Figure 5:
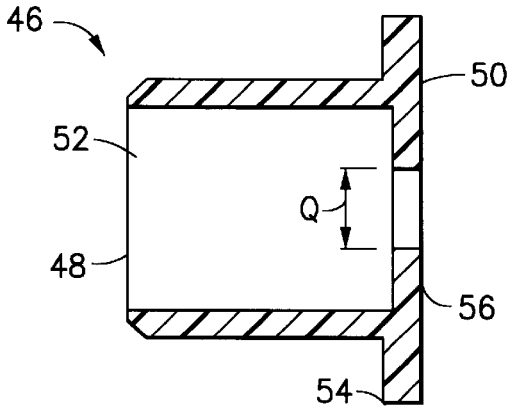
FIG. 5 is a longitudinal cross-sectional view of the rear insulator.

The insulator assembly 14 includes a generally tubular rear insulator 46 having opposed front and rear ends 48 and 50 and a passage 52 extending axially therebetween, as shown most clearly in FIG. 5. The tubular rear insulator 46 has an outer circumference dimensioned for close engagement within the front body 34. The rear end 50 of the rear insulator 46 includes an outwardly extending flange 54 dimensioned for engagement against the rear flange 38 of the front body 34. Thus, the outwardly extending flange 54 on the rear insulator 46 controls and limits the amount of forward movement of the rear insulator 46 into the front body 34. The rear insulator 46 further includes an inwardly extending flange 56 at the rear end 50. The inwardly extending flange 56 of the rear insulator 46 defines an inside diameter "h".

Figure 6:
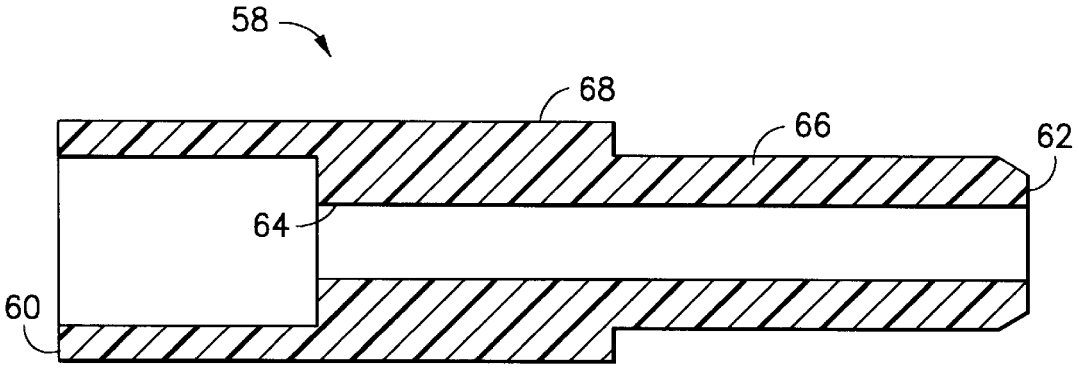
FIG. 6 is a longitudinal cross-sectional view of the front insulator.

The insulator assembly 14 further includes a front insulator 58 having opposed front and rear ends 60 and 62 and a stepped passage 64 extending therebetween as shown in FIG. 6. The front insulator 58 has a stepped outer circumferential surface including a large diameter portion 66 adjacent the front end 60 and a small diameter portion 66 adjacent the rear end 62. The large outer diameter cylindrical portion 66 of the front insulator 58 is dimensioned to be tightly received within the passage 40 of the front body 34. The small outer diameter cylindrical portion 68 of the front insulator 58 is dimensioned to be closely received within the passage 52 of the rear insulator 46. The large diameter portion 66 of the front insulator 58 defines an axial length for positioning the front end 60 of the front end insulator 58 slightly rearwardly of the front end 36 of the front body 34. The diameter portion 68 of the front insulator 58 defines an axial length to position the rear end 62 of the front insulator 58 significantly forwardly of the inwardly extending flange 56 on the rear insulator 46. Thus, a space is defined between the front and rear insulators 46 and 58 of the insulator assembly 14 as shown in FIG. 1.

Figure 7:
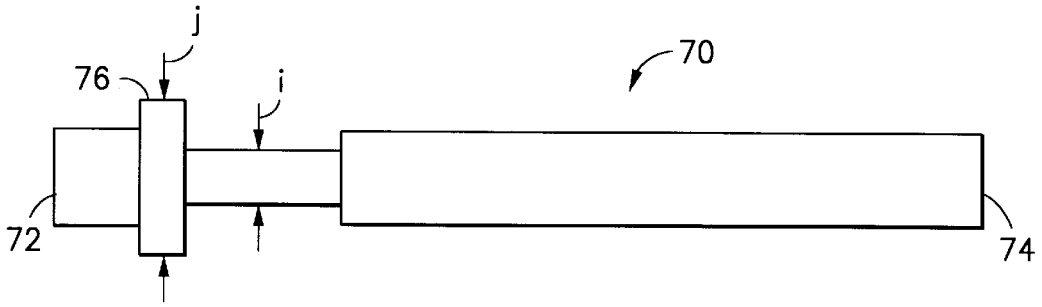
FIG. 7 is a side elevational view of the rear contact.

The contact assembly 16 includes a rear contact 70 having a front end 72 as shown most clearly in FIG. 7. The front end 72 of the rear contact 70 is disposed forwardly of the inwardly extending flange 56 on the rear insulator 46 as illustrated in FIG. 1. The rear contact 70 further includes a rear end 74 disposed rearwardly of the rear insulator 46. Portions of the rear contact 70 near the inwardly extending flange 56 of the rear insulator 46 define a diameter "i" which is less than the inside diameter "h" defined by the inwardly extending flange 56 on the rear insulator 46. Thus, the rear contact 70 is able to float radially relative to the inwardly extending flange 56 on the rear insulator 46. The rear contact 70 further includes an outwardly extending flange 76 disposed forwardly of the inwardly extending flange 56 on the rear insulator 46. The flange 76 on the rear contact 70 defines an outside diameter "j" which exceeds the inside diameter "h" of the inwardly extending flange 56 on the rear insulator 46. Thus, the flange 76 on the rear contact 70 prevents the rear contact 70 from moving rearwardly beyond the rear insulator 46.

Figure 8:
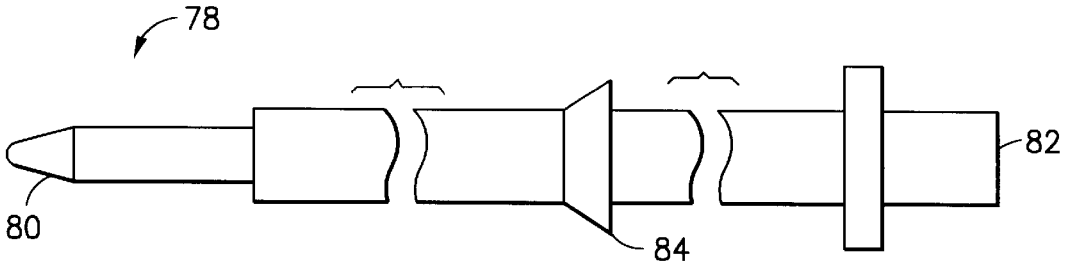
FIG. 8 is a side elevational view of the front contact.

With reference to FIGS. 1 and 8, the contact assembly 16 further includes a front contact 78 having a front end 80 disposed within the large diameter front portion of the passage 64 in the front insulator 58. The front contact 78 further includes a rear end 82 disposed rearwardly of the rear end 62 of the front insulator 58 and forwardly of the front end 72 of the rear contact 70. Intermediate portions of the front contact 78 include a barb 84 embedded in the front insulator 58. Additionally, portions of the front contact 78 immediately adjacent the rear end 62 of the front end insulator 58 define a flange 86.

The contact assembly 16 further includes a coil spring 88 extending between the flange 76 of the rear contact 70 and the flange 86 of the front contact 78. The spring 88 functions to bias the front and rear contacts 78 and 80 away from one another. However, the spring permits movement of the front contact 78 toward the rear contact 70. Additionally, the spring accommodates signal transmission between the front and rear contacts 78 and 70 of the contact assembly 16.

In use, the rear body 18 and the rear contact 70 are mounted to the circuit board 17 by passing the legs 32 of the rear body 18 through holes 90 in the circuit board 17 and by passing the rear end 74 of the rear contact 70 through a hole 92 in the circuit board 17. The legs 32 of the rear body 18 then are electrically connected to conductive traces 33 on the circuit board 17 to ground the connector 10. The rear contact 70 is then connected to conductive traces 98 on the circuit board 17 to permit transmission of a signal through the contact assembly 16.

The circuit board 17 to which the rear body 18 and the rear contact 70 are mounted may then be urged into mating contact with another coaxially connector that may also be mounted to a circuit board. As noted above, this mating often is carried out without an ability to directly observe and align the connectors. This blind mating frequently results in misalignment of the connector 10 with the mating connector. Such misalignment is compensated for with the coaxial connector 10. In particular misaligned mating forces initially will be exerted upon the front body 34 and will cause the front body 34 to axially float, radial float and/or angularly move about an axis angularly aligned to the contact assembly 16. The front contact 78 will float concentrically with the front body 34 in response to these misaligned mating forces. However, the misaligned mating forces will not exert potentially damaging forces on the rear body 18, the rear contact 70, the circuit board 17 or any of the soldered electrical connections between the coaxial connector 10 and the conductive traces 33 and 98 on the circuit board 17. The multi-directional float enabled by the subject coaxial connector 10 does not significantly affect signal carrying performance. In particular, the coil spring 88 maintains continuous engagement with the front and rear contacts 78 and 70 and accommodates signal transmission therebetween independent of the angular alignment and/or float position. Similarly, the wave washer 44 maintains contact between the front and rear bodies 18 and 34 even in the presence of the complex multi-directional float enabled by the connector 10.

While the invention has been described with respect to a preferred embodiment, it is apparent that various changes can be made without departing from the scope of the invention as defined by the appended claims. For example, the size and/or shape of the front and rear bodies can vary from those shown herein, and the relative structures for mounting to a circuit board or to mate with another connector can vary. These and other changes will be apparent to a person skilled in this art after having read the subject disclosure.

What is claimed is:

1. A coaxial connector for mounting to a circuit board, said connector comprising:

a body assembly having a rear body with means for secure mounting to the circuit board, a front body floatably moveable relative to the rear body and a spring between the front and rear bodies for maintaining electrical contact therebetween for all relative positions of said front and rear bodies; and a contact assembly comprising a rear contact concentrically fixedly supported within said rear body, said rear contact having means for secure mounting to the circuit board, a front contact spaced from said rear contact and being concentrically supported with said front body, and a resiliently deflectable connecting means extending between said front and rear contacts for maintaining signal transmission between said front and rear contacts for all relative floatably moveable positions of said front contact relative to said rear contact.

2. The coaxial connector of claim 1, further comprising an insulator disposed between said body assembly and said contact assembly, said insulator maintaining separation between said body assembly and said contact assembly and supporting said front contact of said contact assembly relative to said front body.

3. The coaxial connector of claim 2, wherein said insulator is dimensioned for movement relative to said rear contact in response to floating movement of said front body and said front contact.

4. The coaxial connector of claim 2, wherein said insulator comprises front and rear insulators rigidly engaged with one another and rigidly engaged in said front body, said front and rear insulators being formed to define a space therebetween, said resiliently deflectable connecting means and portions of said front and rear contacts being disposed in said space between said front and rear insulators.

5. The coaxial connector of claim 1, wherein the spring comprises a wave washer extending between said front and rear bodies.

6. The coaxial connector of claim 1, wherein said resiliently deflectable connecting means of said contact assembly comprises a coil spring, said coil spring having a rear end concentrically surrounding portions of said rear contact and a front end concentrically surrounding portions of said front contact.

7. A coaxial connector for mounting to a circuit board, said connector comprising:

a rear body having front and rear faces and a passage extending therebetween, an inwardly extending flange in said passage, and ground connection means projecting from said rear body for soldered connection to a ground on the circuit board;

a tubular front body movably mounted through said inwardly extending flange of said rear body, said front body including an outwardly extending rear flange disposed rearwardly of said inwardly extending flange of said rear body and an outwardly extending front flange forwardly of said rear body;

a wave washer biasingly engaged between said front face of said rear body and said front flange of said front body for maintaining electrical connection between said front and rear bodies;

a generally tubular rear insulator having opposed front and rear ends and a passage extending therebetween, an inwardly extending flange at said rear end of said rear insulator, said rear insulator being securely engaged within said tubular front body;

a front insulator having front and rear ends and a passage extending therethrough, said front insulator being securely engaged in said tubular front body forwardly of said flange of said rear body;

a rear contact having opposed front and rear ends, said rear end of said rear contact being securely connectable to a signal-carrying conductor on the circuit board, the front end of said rear contact being fixedly disposed between said front insulator and said flange of said rear insulator;

a front contact having front and rear ends, portions of said front contact intermediate said ends being securely engaged in said passage through said front insulator, said rear end of said front contact being disposed between said front insulator and said rear contact; and a coil spring extending between and connecting said front and rear contacts, for permitting floatable movement of said front and rear contacts relative to one another and for maintaining signal transmission therebetween.

8. The coaxial connector of claim 7, wherein said rear contact includes a flange in proximity to said front end, said front contact including a flange in proximity said rear end, said coil spring being engaging against said flanges of said front rear contacts for contributing to signal transmission and for urging said front and rear contacts away from one another.

* * * * *